US006623003B1

(12) United States Patent
Koizumi et al.

(10) Patent No.: US 6,623,003 B1
(45) Date of Patent: Sep. 23, 2003

(54) SHEET MATERIAL STACKING DEVICE AND AUTOMATIC EXPOSURE DEVICE FOR A PRINTING PLATE

(75) Inventors: Takashi Koizumi, Kanagawa (JP); Kazuhisa Okamoto, Kanagawa (JP); Yoshinori Kawamura, Kanagawa (JP); Yoshihiro Koyanagi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/664,412

(22) Filed: Sep. 18, 2000

(30) Foreign Application Priority Data

Sep. 17, 1999 (JP) ..... 11-264119

(51) Int. Cl.[7] ..... B65H 29/00

(52) U.S. Cl. ..... 271/270; 271/202; 271/300; 271/302; 271/208; 347/264; 101/463.1

(58) Field of Search ..... 347/264; 101/463.1; 271/202, 270, 279, 280, 300, 302, 207, 208

(56) References Cited

U.S. PATENT DOCUMENTS 4,350,333 A * 9/1982 Landa ..... 271/217
4,861,014 A * 8/1989 Martin ..... 271/198
5,131,645 A * 7/1992 Ricciardi ..... 271/181
5,732,315 A * 3/1998 Inoue et al. ..... 399/317
6,135,448 A * 10/2000 Daito ..... 271/270
6,179,495 B1 * 1/2001 Sugata et al. ..... 396/612
6,328,300 B1 * 12/2001 Stefan et al. ..... 271/2

FOREIGN PATENT DOCUMENTS

JP 10254144 * 9/1998

* cited by examiner

*Primary Examiner*—Patrick Mackey
(74) *Attorney, Agent, or Firm*—Sughrue Mion, PLLC

(57) ABSTRACT

A sheet material stacking device and an automatic exposure device for a printing plate, capable of stacking a number of interleaf sheets stably and efficiently. A pair of skewered rollers are provided at the sheet material stacking device used for the automatic exposure device. An interleaf sheet, which is fed from an interleaf sheet transport section, is guided by guide plates and nipped by the rollers. The interleaf sheet, while maintaining a so-called stronger pulling tension, is forcibly fed to an interleaf sheet accommodating section and stacked. Even if the interleaf sheet is thin, the interleaf sheet can behave stably as it is being stacked, and a number of the interleaf sheets can be stacked regularly and effectively.

15 Claims, 12 Drawing Sheets

SHEET MATERIAL STACKING DEVICE AND AUTOMATIC EXPOSURE DEVICE FOR A PRINTING PLATE

BACKGROUND OF THE INVENTION

1. Field of the Invention

The present invention relates to a sheet material stacking device for stacking, at a stacking section which is provided at a downstream side, sheet materials which are transported from an upstream side, and to an automatic exposure device for a printing plate by which printing plates which are accommodated in a stacked state are taken one at a time and then ejected after an image has been exposed.

2. Description of the Related Art

A technology has been developed in which, using a printing plate (e.g., a PS (presensitized) plate, a thermal plate, a photopolymer plate, or the like) provided with a recording layer on top of a support, an image is recorded directly on the photopolymer layer of the printing plate by a laser beam or the like (automatic exposure device for a printing plate).

With this sort of technology, images can be recorded on printing plates quickly. Therefore, sequential feeding of the printing plates is required. For this reason, a plurality of the printing plates and interleaf sheets (sheet materials) for protecting surfaces of the printing plates are alternately stored in a magazine in a sequentially stacked state beforehand. In this state, the printing plates and the interleaf sheets are made to standby at predetermined positions, automatically taken one at a time, and fed into an exposure section.

Since the printing plates are photosensitive, they are stored in a darkroom, and there are some cases in which the darkroom is located apart from the place where the automatic exposure device for the printing plate is set. Therefore, a wheeled stand (trolley) for exclusive use is used to convey the printing plates (ordinarily, a plurality of the printing plates are accommodated in a magazine in a stacked state) from the darkroom to the automatic exposure device. The trolley is accommodated at a predetermined position (accommodating section) of the automatic exposure device in a state of having the magazine mounted thereon. After this accommodation, a shutter which is provided at the magazine is opened so that the printing plates can be fed from the darkroom to the automatic exposure device without being exposed to light.

When the printing plates and the interleaf sheets are alternately taken from the magazine which is mounted on the trolley and one of the printing plates is fed into the exposure section, the interleaf sheets which are separated and taken out from the respective surfaces of the printing plates become unnecessary. Accordingly, these interleaf sheets must be stacked at a predetermined interleaf sheet accommodating section. After the interleaf sheets have been separated and taken out from the surfaces of the printing plates, the interleaf sheets are conveyed by a transport belt and dropped into a back space of the magazine which is mounted on the trolley, and structured therein so that they are accommodated.

However, because each of the interleaf sheets is very thin, when an interleaf sheet is dropped, it tends to behave unstably. With such a structure that the interleaf sheets are accommodated by leaving the stacking of the interleaf sheets to a random dropping thereof, there have been drawbacks in that a number of the interleaf sheets lie upon one another irregularly, and are stacked like a heap of garbage which expands largely so that the back space of the magazine readily becomes full of the interleaf sheets. Further, the interleaf sheet which is transported along the transport belt or the like is charged with static electricity during the transport process, thus causing a phenomenon that the interleaf sheet adheres to internal walls of the interleaf sheet accommodating section during the random dropping of the interleaf sheets. This also causes the stacking performance of the interleaf sheets to deteriorate. In other words, in a conventional structure of stacking the interleaf sheets, it has been difficult to efficiently stack a large quantity (a multiple number) of the interleaf sheets in a limited stacking space.

SUMMARY OF THE INVENTION

In view of the aforementioned facts, it is an object of the present invention to provide a sheet material stacking device and an automatic exposure device for a printing plate which are able to stack a number of sheet materials such as interleaf sheets stably and effectively.

An aspect of the present invention is a sheet material stacking device for stacking, at a stacking section which is provided at a downstream side, sheet materials which are transported from an upstream side, comprising: a pair of nipping and feeding members which are disposed at a sheet material transport direction upstream side of the stacking section, which receive the sheet materials which are transported from the upstream side, and which forcibly feed the sheet material to the stacking section; and a guiding device which is disposed at the sheet material transport direction upstream side of the nipping and feeding members, and which guides the sheet materials which are transported from the upstream side into a gap between the nipping and feeding members which face each other.

The sheet material which has been transported from the upstream side is fed into the gap between the nipping and feeding members which face each other, as it is being guided by the guiding device. The sheet material fed into the gap is forcibly fed to the stacking section and stacked. Accordingly, even when the sheet material is extremely thin, this sheet material can behave stably as compared to a case in which the sheet materials are dropped at random and stacked, and can be stacked regularly at the stacking section. Further, a number of the sheet materials can be stacked effectively at the stacking section having a limited space.

Preferably, the sheet material is nipped and transported by the nipping and feeding members at a speed which is faster than the speed at which the sheet material is transported from the upstream side. Therefore, the sheet material which is nipped by the nipping and feeding members maintains a so-called stronger pulling tension, and prevents slackening of the sheet material as the sheet material is being nipped by the nipping and feeding members. As a result, the sheet material does not cause so-called jamming, and can be stacked stably.

Preferably, the nipping and feeding members are the nipping and feeding rollers, i.e., a plurality of skewered rollers provided at a rotational shaft. Therefore, because the sheet material is nipped and transported by the skewered rollers, even when the sheet material is extremely thin, the sheet material cannot wrinkle easily so that the sheet material can be nipped, transported, and fed stably.

Preferably, the sheet material stacking device, further comprising wrap-around prevention boards which are provided such that they follow along projections and indentations formed by each of the plurality of the skewered rollers which are provided at the rotational shaft and which prevent the sheet material which has passed through between the skewered rollers from engaging again with the skewered rollers. Accordingly, since the wrap-around prevention boards are disposed such that then follow along projections and indentations formed by the skewered rollers, the sheet material, which has passed through the skewered rollers and which has been stacked at the stacking section, is prevented from once again wrapping around the skewered rollers.

Preferably, the guiding device has anti-static brushes which engage with the sheet material which is guided into the gap and which remove static electricity (electric charge) from the sheet material. Therefore, the anti-static brushes engage the sheet materials which are guided into the gap between the facing nipping and feeding members and remove static electricity therefrom. Accordingly, the respective sheet materials, which pass through the rollers 144 and which are fed to the interleaf sheet accommodating section, do not unnecessarily adhere to internal walls of the interleaf accommodating section, thus not deteriorating stacking efficiency of the sheet materials.

Another aspect of the present invention is an automatic exposure device for a printing plate which comprises: a conveying device which is able to mount and convey a magazine in which a plurality of printing plates, each of which has a photosensitive layer on top of a support, and a plurality of interleaf sheets for protecting plate surfaces of the printing plates are in a state of being stacked alternately in a sequential order; and an accommodating device which is able to accommodate the conveying device of the printing plates, and which ejects the printing plates after an image has been exposed; a take-out device which alternately takes the printing plates and the interleaf sheets from the stacked state thereof one at a time from the magazine; and an interleaf sheet stacking device which stacks the interleaf sheets which are transported from the take-out device at an upstream side, at the interleaf sheet accommodating section which is provided at a downstream side, wherein the interleaf stacking device comprises: a pair of nipping and feeding members which are disposed at the interleaf sheet transport direction upstream side of the interleaf sheet accommodating section, which receive the interleaf sheets which are transported from the take-out device, and which forcibly feed the interleaf sheets to the interleaf sheet accommodating section; and a guiding device which is disposed at the interleaf sheet transport direction upstream side of the interleaf sheet accommodating section, and which guides the interleaf sheets which are transported from the take-out device into a gap between the nipping and feeding members.

Therefore, even when the interleaf sheets are extremely thin, as compared to a case of random dropping and stacking of the interleaf sheets, the interleaf sheets can behave stably and can be stacked regularly. Further, a number of interleaf sheets can be stacked effectively at the interleaf sheet accommodating section which has a limited space.

DESCRIPTION OF THE PREFERRED EMBODIMENTS

Figure 1:
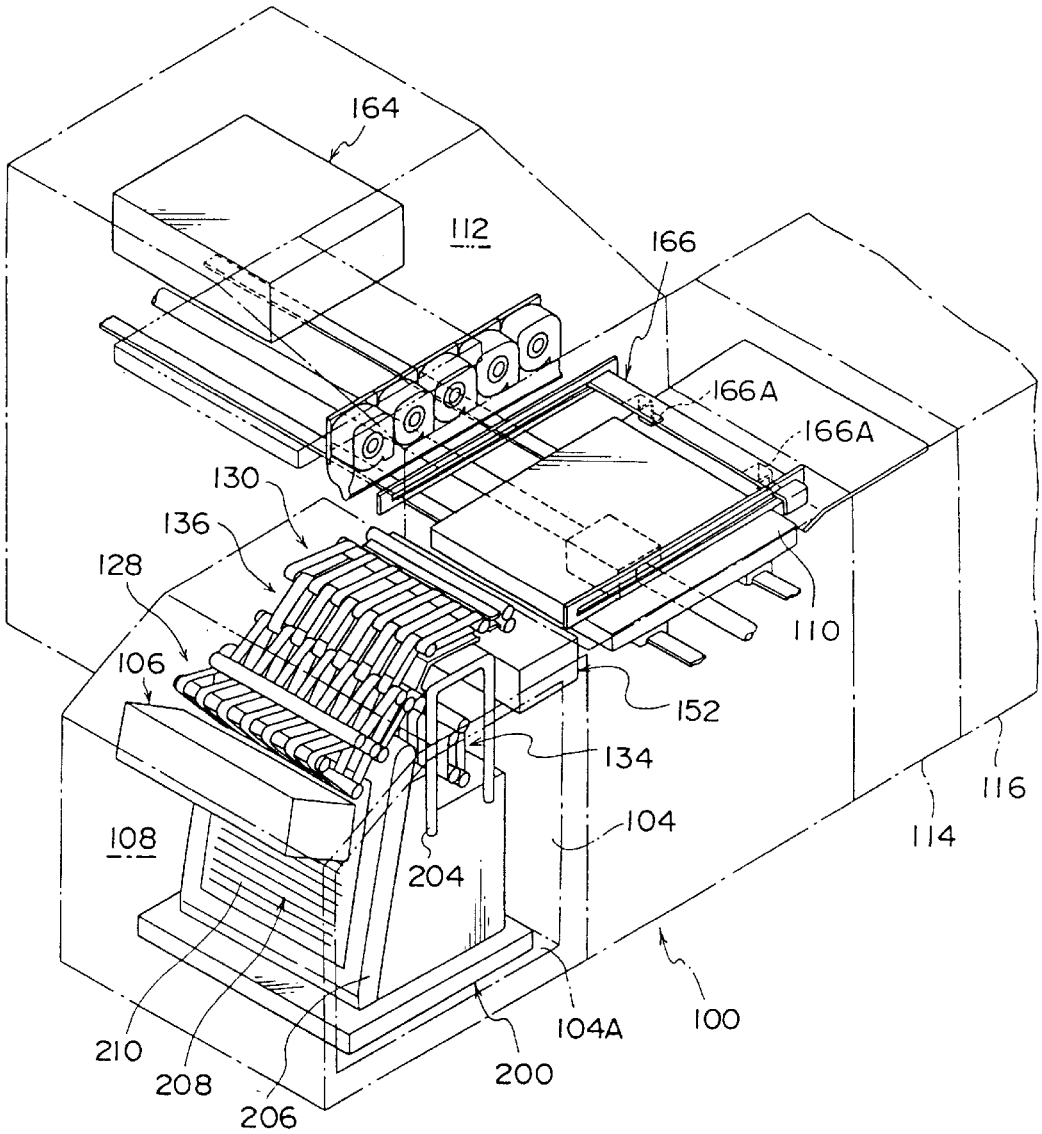
FIG. 1 is a perspective view showing an overall structure of an automatic exposure device relating to an embodiment of the present invention.

FIG. 1 is a perspective view showing an overall structure of a photopolymer plate (printing plate) automatic exposure device 100 having a sheet material stacking device 141 relating to an embodiment of the present invention.

The automatic exposure device 100 is formed by a plate feed section 108, a surface plate (an exposure stage) 110 and an exposure section 112. The plate feed section 108 is provided with a plate accommodation section 104, which accommodates as a trolley accommodation section photopolymer plates 102 (see FIG. 2) mounted on a trolley 200, and a sheet delivery section 106, which takes out the photopolymer plates 102 accommodated at the plate accommodation section 104. The exposure section 112 records an image onto the photopolymer plate 102 that is held in position on the surface plate 110.

Further, an automatic developing device 116 can be established at the downstream side of the automatic exposure device 100 via a buffer section 114. Thus, plate feeding, exposure and developing can all be processed automatically.

Figure 2:
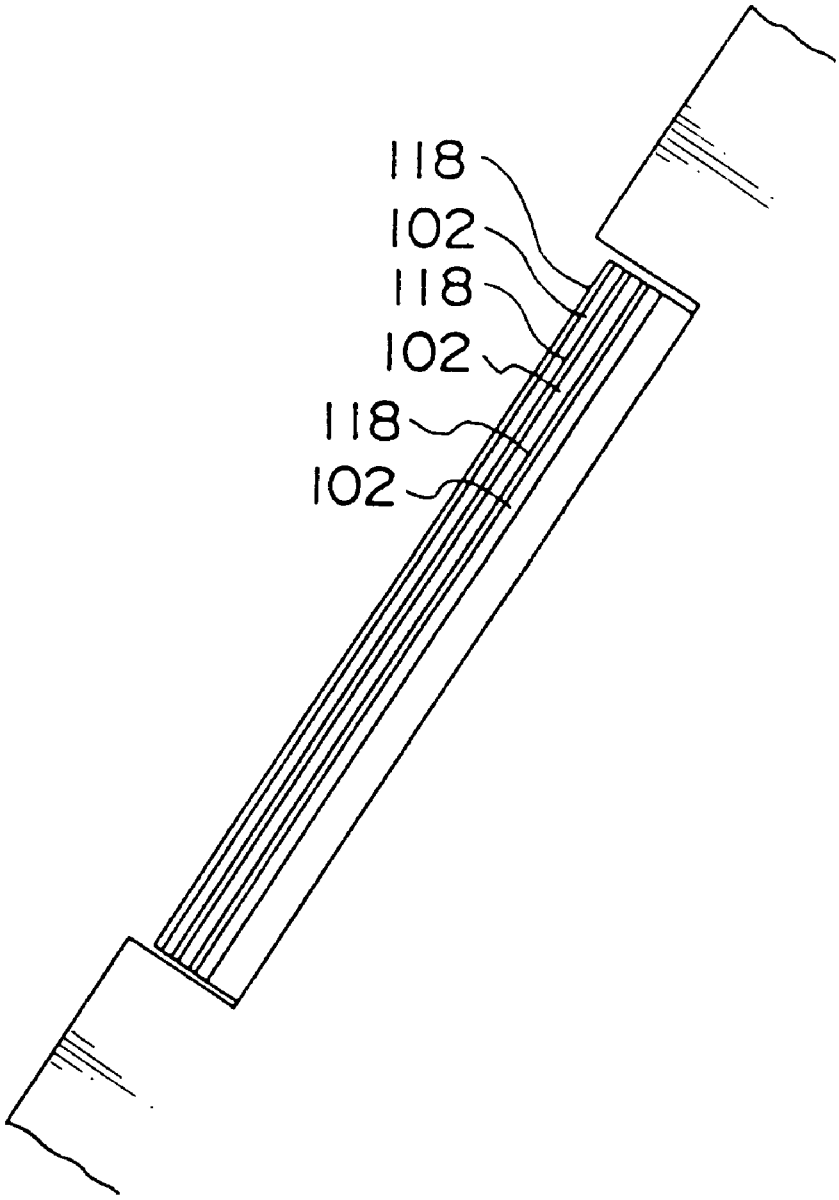
FIG. 2 is a side view showing a state of photopolymer plates and interleaf sheets which are mounted in a magazine.
Figure 3:
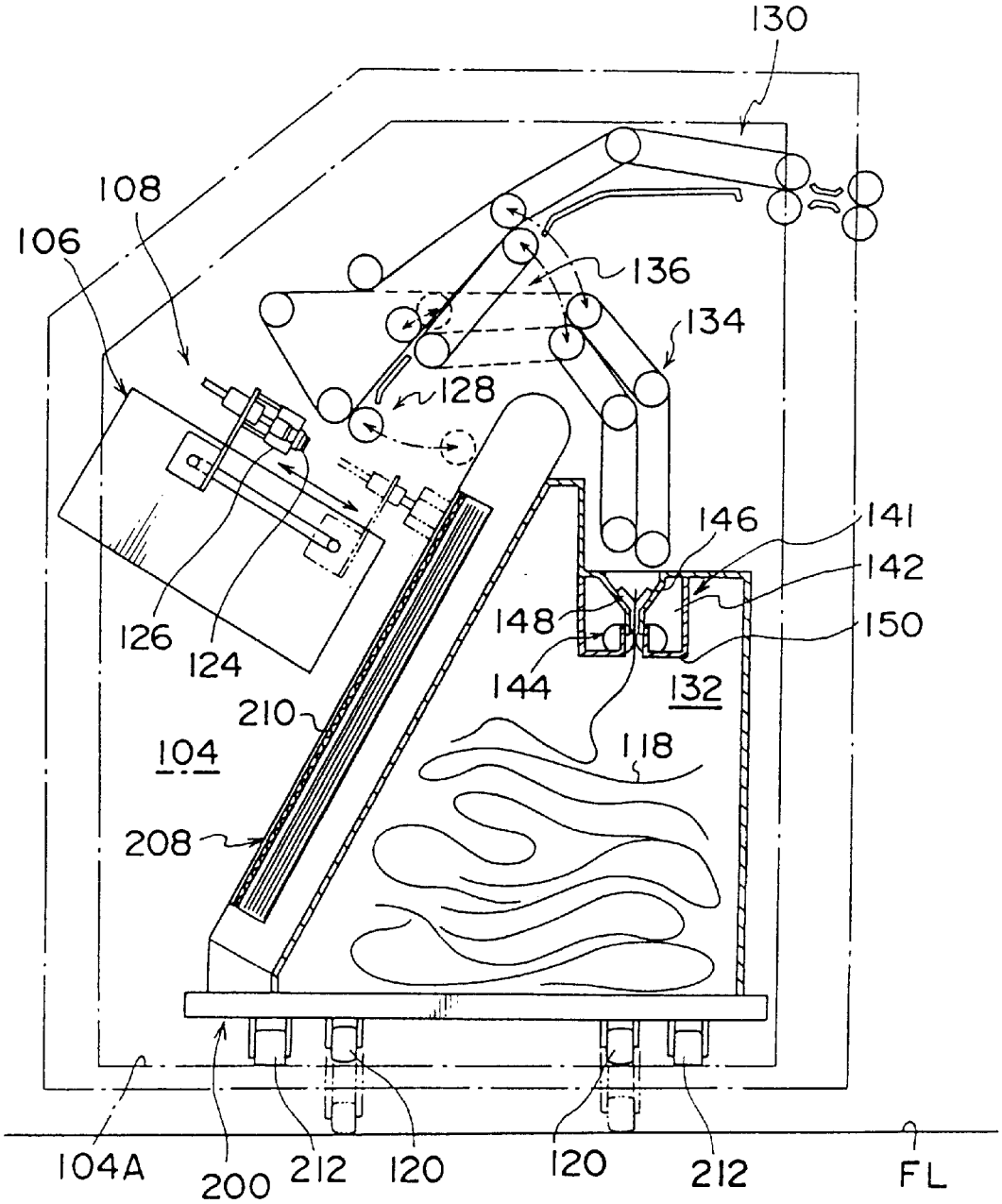
FIG. 3 is a side view of a plate feed section.

As shown in FIGS. 2 and 3, a trolley 200, at which a plurality of photopolymer plates 102 are propped up, can be accommodated by the plate accommodation section 104. Further, one protective interleaf sheet 118 is provided at the surface of each photopolymer plate 102. Thus, the photopolymer sheets 102 and the interleaf sheets 118 are stacked alternately.

A floor portion 104A of the plate accommodating section 104 is formed at a position higher than a floor surface (FL). The trolley 200 is structured such that it is moved from the floor surface to the floor portion 104A. That is, casters 120 can be moved relative to the trolley 200 between an extended position (a position shown by broken lines in FIG. 3) and an accommodated position (a position shown by solid lines in FIG. 3) in which the casters are withdrawn.

In accordance with an accommodation movement to the plate accommodating section 104, the casters 120 are moved and positioned at the accommodated position and, at the same time, auxiliary rollers 212 make contact with the floor portion 104A. Subsequently, the trolley 200 is supported relative to the floor portion 104A by the auxiliary rollers 212.

A sheet delivery section 106 is provided at an upper portion of the plate accommodation section 104. In order to alternately take the photopolymer plates 102 and the interleaf sheets 118 from the stacked state thereof and pass them onto the plate feed section 108, the sheet delivery section 106 is provided with a sucker 124 which sucks the photopolymer plates 102 and the interleaf sheets 118. Further, in the vicinity of the sucker 124 but separate from the sucker 124, a suction fan 126 is provided as a means of assistance when one of the interleaf sheets 118 is being sucked. The sucker 124 and the suction fan 126 can be integrally moved closer to or further from the surface of the integrally stacked interleaf sheets 118 and photopolymer plates 102.

When one of the photopolymer plates 102 is to be sucked, the sucker 124 makes contact with the photopolymer plate 102 and sucks. However, when one of the interleaf sheets 118 is to be sucked, the suction fan 126 is disposed a small distance from the interleaf sheet 118 (contact is acceptable) and the suction fan 126 operates alone such that only the lightweight, thin interleaf sheet 118 is sucked up, after which the sucker 124 starts to suck. Hence, when the interleaf sheet 118 is sucked, double suction (sucking the photopolymer plate 102 that is underneath together with the interleaf sheet 118) is prevented.

The major portions forming the plate feed section 108 are a common transport section 128, a photopolymer plate transport section 130, an interleaf sheet transport section 134, and a switching transport section 136. The common transport section 128 receives the photopolymer plates 102 and the interleaf sheets 118 from the aforementioned sheet delivery section 106 and transports the same. The photopolymer plate transport section 130 receives the photopolymer sheets 102 and sends the same to the surface plate 110. The interleaf sheet transport section 134 receives the interleaf sheets 118 and sends the same to an interleaf sheet accommodation section 132 (mounted at the trolley 200). The switching transport section 136 switches to guide a photopolymer plate 102 or an interleaf sheet 118 from the common transport section 128 to one of the photopolymer plate transport section 130 and the interleaf sheet transport section 134.

The photopolymer plates 102 and the interleaf sheets 118 are transported to different destinations. Therefore, the switching transport section 136 switches each time the sheet delivery section 106 sucks, and is structured such that the photopolymer plates 102 and the interleaf sheets 118 are transferred respectively to their destinations.

Figure 4A:
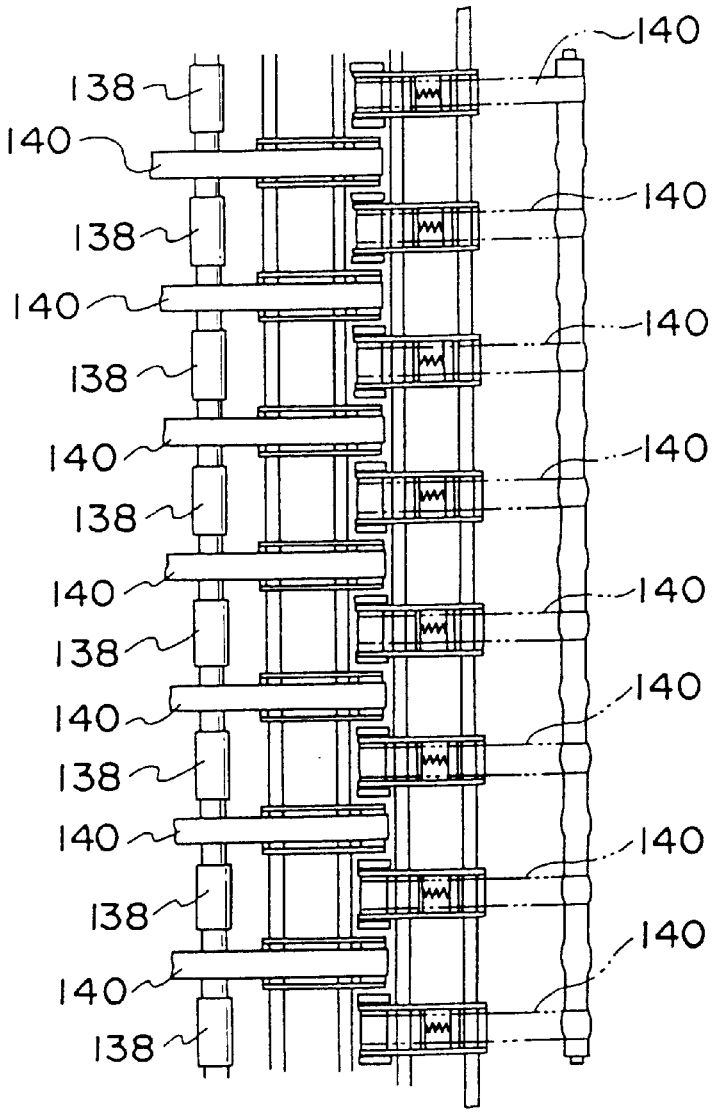
FIG. 4A is a plan view showing a main portion of a transport system of the plate feed section.
Figure 4B:
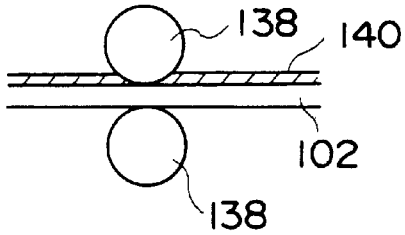
FIG. 4B is a side view showing a main portion of the transport system of the plate feed section.

As shown in FIG. 4A, the common transport section 128, the photopolymer plate transport section 130 and the switching transport section 136 are structured by a transport system in which skewered rollers 138 and narrow belts 140 are combined as a means of transporting the photopolymer plates 102 (see FIG. 4B). The photopolymer plates 102 are transported by a strong nipping force of the skewered rollers 138, and the narrow belts 140 serve as guide plates which move synchronously with transport.

Figure 4C:
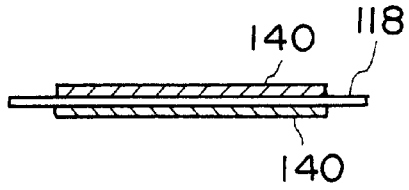
FIG. 4C is a side view showing a main portion of an interleaf sheet transport section.

At the interleaf sheet transport section 134, however, the narrow belts 140 alone form a transport system, as shown in FIG. 4C. In this structure, the interleaf sheets 118 are transported by the weak nipping force of the narrow belts 140.

Figure 5:
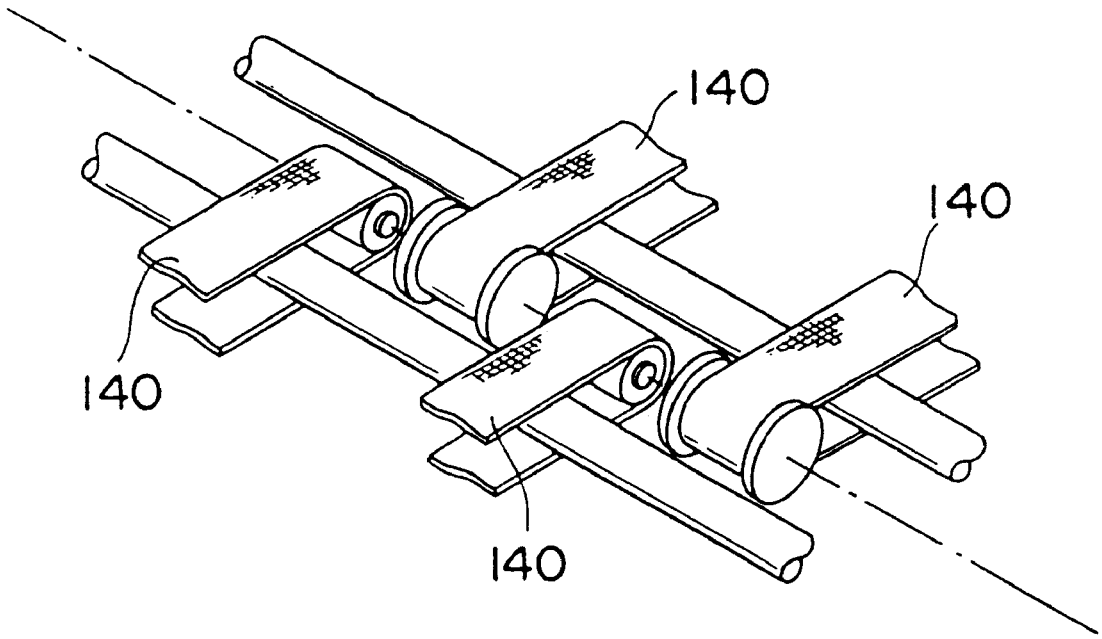
FIG. 5 is a perspective view showing a transfer portion of another transport system of the plate feed section.

As shown in FIG. 5, the hand-over (delivery) portion between two transport sections is in a skewered shape with end portions of the transport sections protruding respectively alternately, such that where one transport: section protrudes the other recedes, and vice versa. Thus, the two transport sections intermesh from opposite sides (with narrow belt end portion support rollers having a common axis). Therefore, when one-of the photopolymer plates 102 or one of the interleaf sheets 118 is handed over, wrapping thereof around the skewered rollers 138 and the narrow belts 140 is prevented.

As shown in FIG. 3, the interleaf sheets 118 that are transported by the interleaf sheet transport section 134 are guided to the interleaf sheet accommodation section 132, which serves as a stacking section, by a sheet material stacking device 141 which is provided at the trolley 200.

Figure 6:
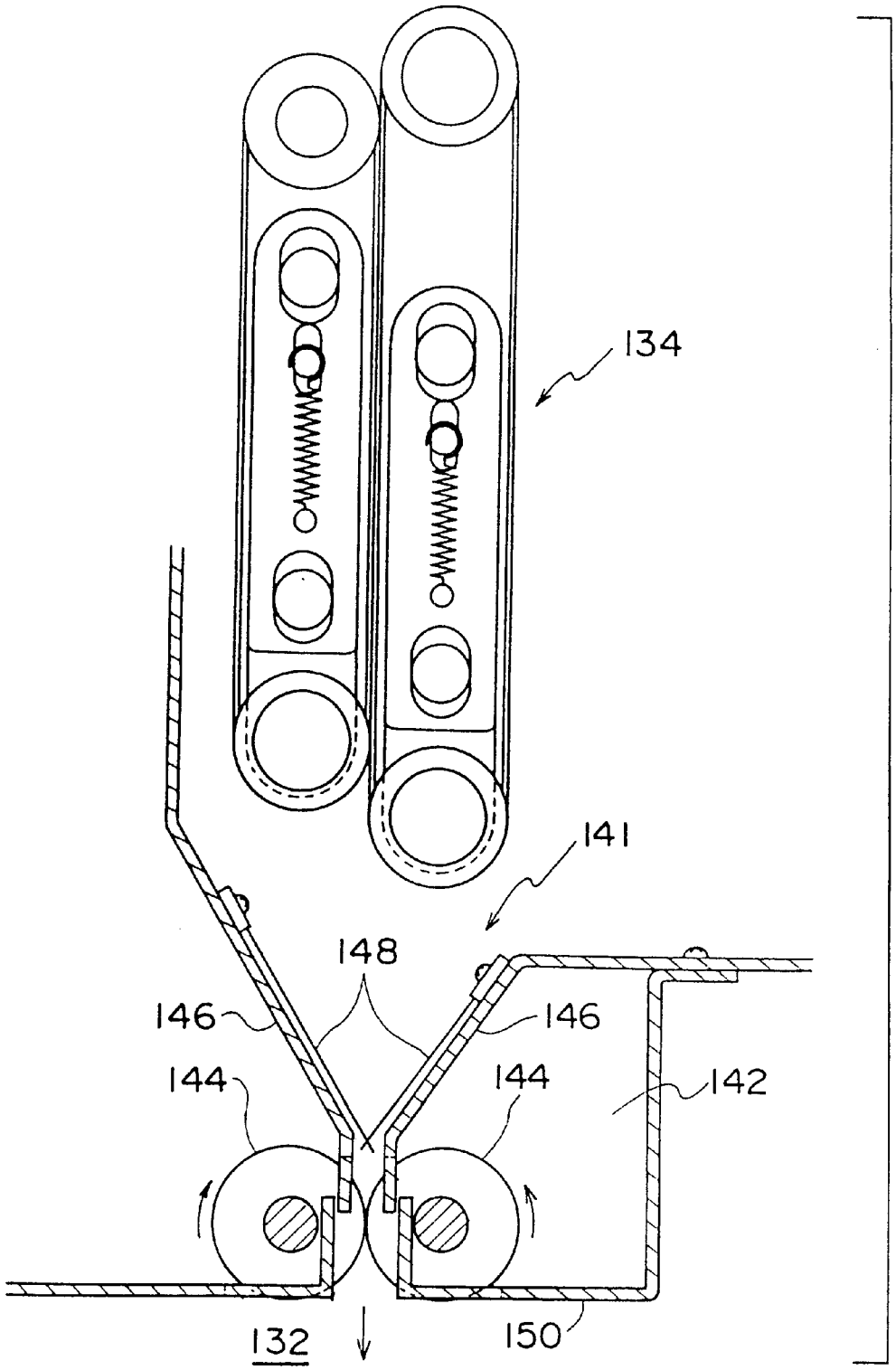
FIG. 6 is a cross-sectional view illustrating details of a sheet material stacking device.

With reference to FIG. 6, the sheet material stacking device 141 will be explained in more detail.

Figure 7:
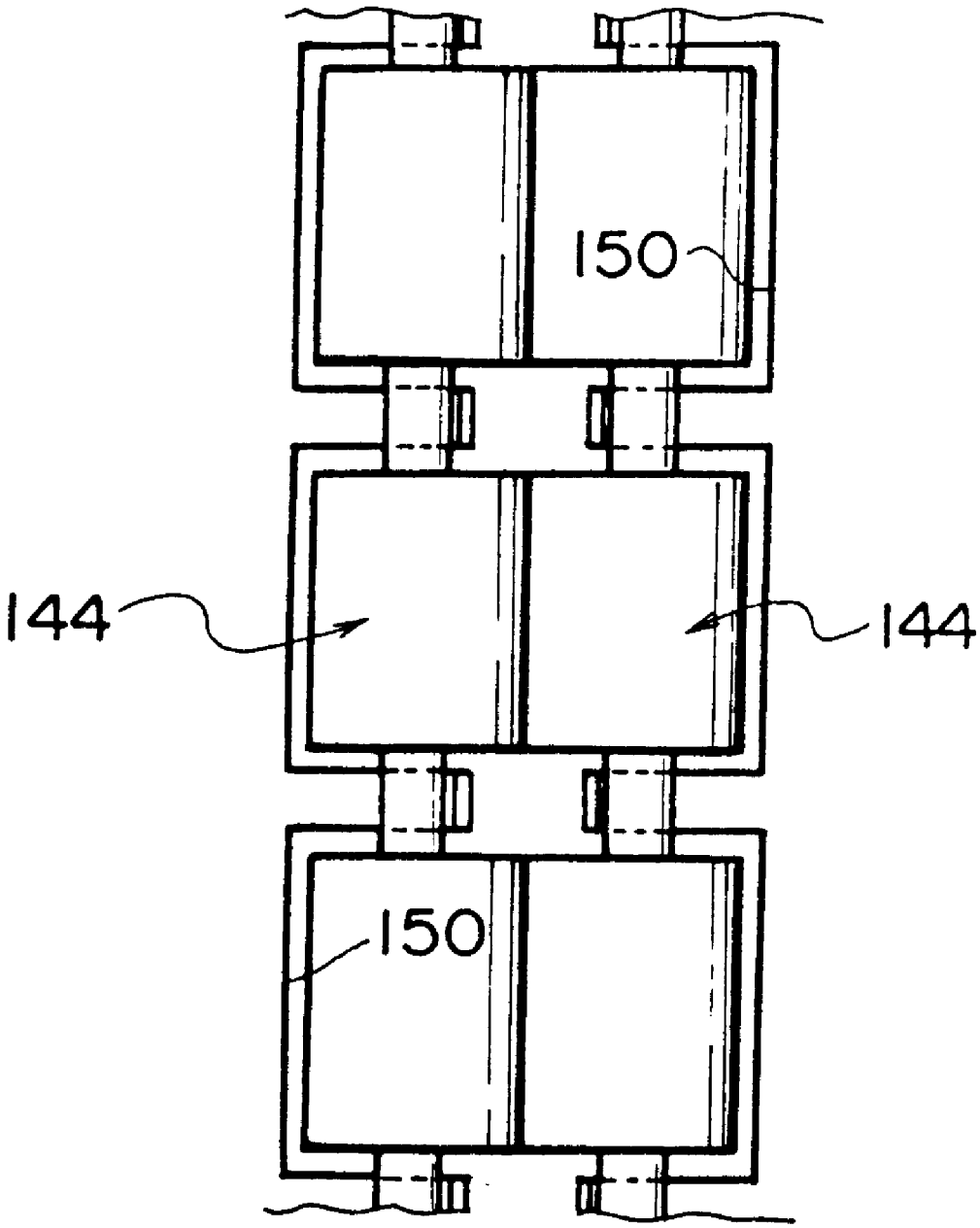
FIG. 7 is a plan view illustrating rollers and a wrap-around prevention board of the sheet material stacking device.

A pair of rollers 144, as nipping and feeding rollers, are provided at an insertion slot 142 for an interleaf sheet 118, which insertion slot is provided at the upper portion of the interleaf sheet accommodation section 132. As shown in FIG. 7, each of the pair of rollers 144 has a skewered form. The rollers 144 are rotarily driven at a linear speed slightly faster than the speed of the interleaf sheet transport section 134 (about 1.1 times as fast). Thus, when one of the interleaf sheets 118 passes down between the rollers 144, the interleaf sheet 118 maintains a state of predetermined tension (as a so-called stronger pulling tension) as it is transported, and jamming due to slackness or the like can be prevented.

As described above, at the interleaf sheet transport section 134, since a difference is made between the nipping forces of the narrow belts 140 and the rollers 144 with respect to the interleaf sheet 118, and the nipping force of the narrow belts 140 is set to be weaker than that of the rollers 144, a transport speed difference between the narrow belts 140 and the rollers 144 can be absorbed effectively. Accordingly, the interleaf sheets 118 can be prevented from being damaged due to slipping.

Further, at the interleaf sheet transport section 134 side of the insertion slot 142, guide plates 146 are provided which gradually taper to reduce the width therebetween (which width is in the direction of the thickness of the interleaf sheets 118) and which face each other. At the thus-tapered guide plates 146, anti-static brushes 148 are respectively attached, which anti-static brushes 148 remove electric charge from the interleaf sheets 118 that are inserted into the insertion slot 142.

In the vicinity of the lower portion of the aforementioned pair of the rollers 144, wrap-around prevention boards 150 are provided such that they follow along projections and indentations formed by the skewered form of each of the rollers 144. A width of the outlet portion between the guide plates 146 which face each other is smaller than a width of the inlet portion between the wrap-around prevention boards 150 which face each other. Portions of the guide plates 146 fit into the wrap-around prevention boards 150. Due to this guiding structure of the guiding plates 146, the interleaf sheet 118 can be reliably discharged to the interleaf sheet accommodation section 132 provided at the downstream side. Thus, even if portions of the interleaf sheets 118 which have passed through the rollers 144 and been stacked in the interleaf sheet accommodation section 132 come into contact with the rollers 144, wrap-around can be prevented by the wrap-around prevention board 150.

As shown in FIG. 1, the photopolymer plates 102 transported by the photopolymer plate transport section 130 leave the photopolymer plate transport section 130 in a horizontal state and are handed over to the surface plate 110.

Figure 8A:
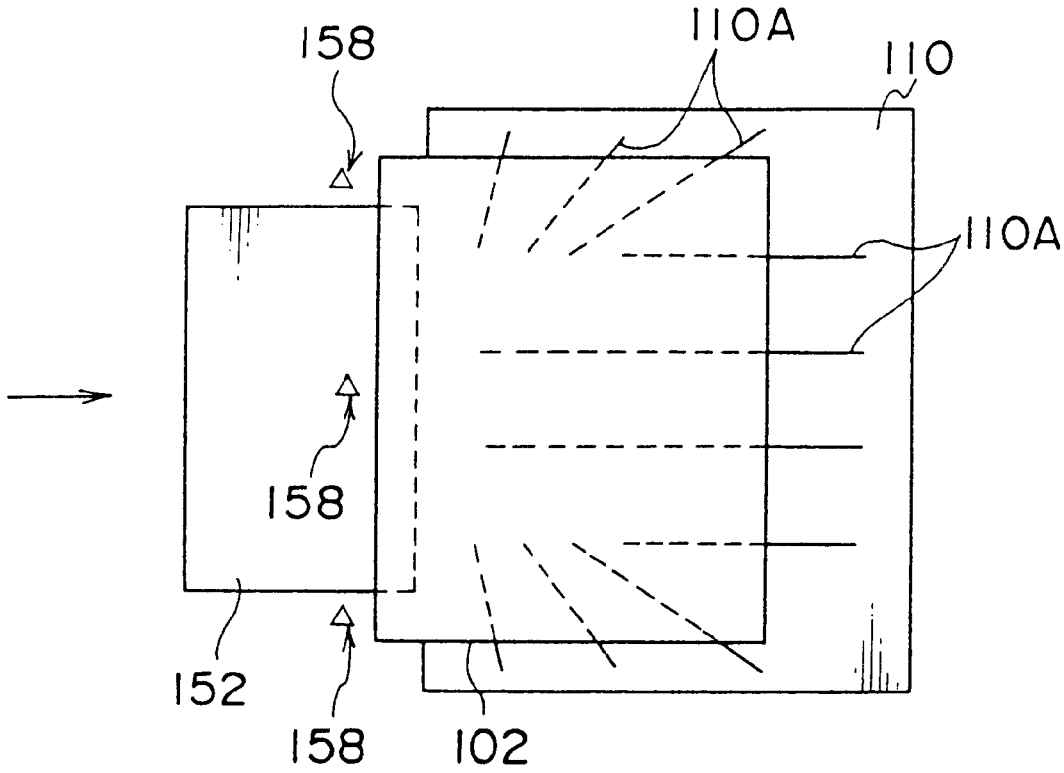
FIG. 8A is a plan view of a plate surface.
Figure 8B:
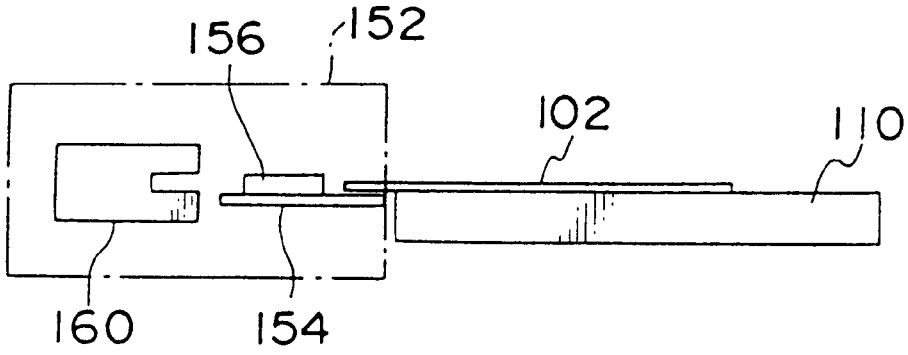
FIG. 8B is a side view of the plate surface.

A top surface height of the surface plate 110 is at a position lower than the height of horizontal transport of the photopolymer plate transport section 130, and a little separated therefrom in the transport direction. Therefore, when ejected from the photopolymer plate transport section 130, the photopolymer plate 102 hangs down a little when landing on the surface plate 110, and the transport direction back end of the photopolymer plate 102 is disposed in a position further toward the photopolymer plate transport section 130 side than the surface plate 110. As shown in FIGS. 8A and 8B, a temporary support arm 154, which is provided at an eject mechanism section 166 which will be described later, is disposed at the position further toward the photopolymer plate transport section 130 side than the surface plate 110. The temporary support arm 154 prevents the photopolymer plate 102 from hanging down.

In the vicinity of the temporary support arm 154 is provided a moving body 152 which can move toward or away from the surface plate 110. At the moving body 152 is provided a pushing plate 156 which pushes the back end of the photopolymer plate 102 in the transport direction. As the back end of the photopolymer plate 102 is pushed by the pushing plate 156, obliqueness of the photopolymer plate 102 is substantially eliminated and the photopolymer plate 102 can be fed to a predetermined transport direction standard position. At this standard position, the transport direction back end portion of the photopolymer plate 102 is in a state of slightly projecting from the surface plate 110.

At this standard position, sensors 158 are provided at a plurality of positions, including both corner portions of the transport direction back end portion of the photopolymer plate 102. When the sensors 158 detect the transport direction back end portion of the photopolymer plate 102, the push of the pushing plate 156 is stopped. Further, the sensors 158 are also used for position detection of the widthwise transport direction of the photopolymer plate 102. That is, the surface plate 110 moves in the widthwise transport direction of the photopolymer plate 102 to make the sensors 158 and the corners of the photopolymer plate 102 correspond. This position is recorded as an initial position of the photopolymer plate 102.

The photopolymer plate 102, which has been moved to the initial position, is positioned relative to an exposure scanning start position in an exposure section 112. The photopolymer plate 102 is held in this state by suction from suction channels 110A which are provided at the surface plate 110.

Punch holes punched by a puncher 160 which is provided at the moving body 152 are provided on the photopolymer plate 102 which is held by suction.

Further, in order to be positioned along a direction transverse to the transport direction, the surface plate 110 can move at a uniform velocity (common directions to the widthwise direction of transport movement of the photopolymer plate 102) between a first position, at which the surface plate 110 receives the photopolymer plate 102 from the photopolymer plate transport section 130 (see the position shown by solid lines in FIG. 1) and a second position, at which the surface plate 110 is accommodated at the exposure section 112 (see the position shown by broken lines in FIG. 1).

At the exposure section 112, a scanning unit 164 is provided above a transport path of the surface plate 110. A laser beam, whose light is controlled according to an image signal, forms a main scanner (in a direction orthogonal to a transport direction of the surface plate 110). Outward transport of the surface plate 110 (toward the exposure section 112) is a sub-scanning movement. Thus, an image is recorded onto the photopolymer plate 102 on the surface plate 110 at the time of the outward transport to the exposure section 112. The surface plate 110 is returned to an original position by return transport (away from the exposure section 112). Then, after the photopolymer plate 102 on the surface plate 110 has been returned to the original position, the suction holding the photopolymer plate 102 is released.

After the image has been recorded and the surface plate 110 having the photopolymer plate 102 thereon has been returned to the original position, the photopolymer plate 102 is ejected in the direction of the photopolymer plate transport section 130 by an eject mechanism section 166 which is provided at the backside of the transport direction of the photopolymer plate 102 (i.e., at the side opposite from the moving body 152).

Figure 9A:
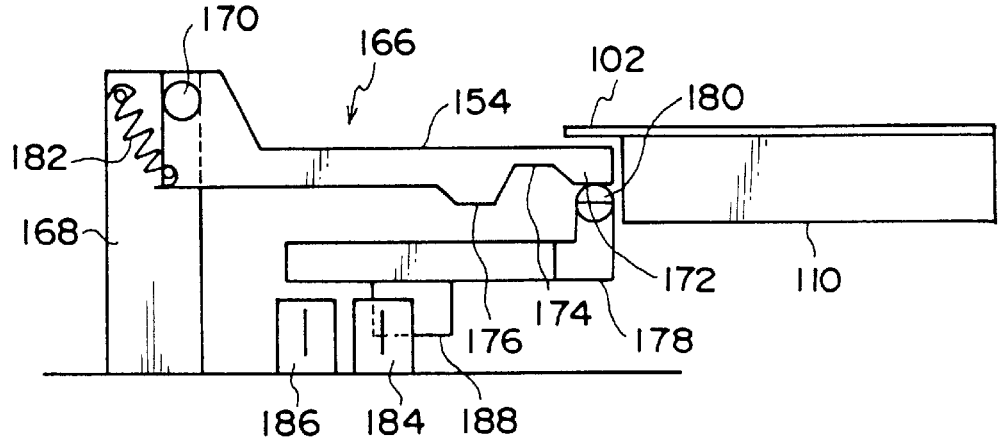
FIG. 9A is a side view of the movement of an eject mechanism section, and illustrates a state in which a temporary support arm is at a horizontal position.
Figure 9B:
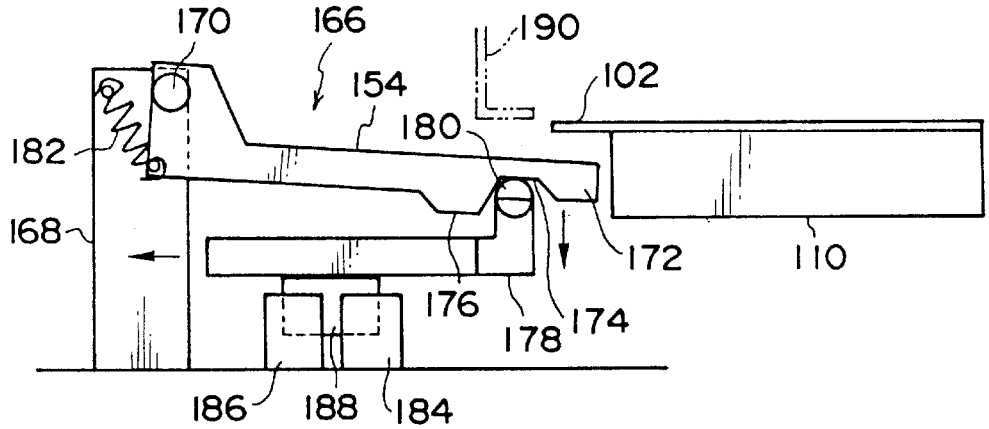
FIG. 9B is a side view of the movement of the eject mechanism section and illustrates a state in which the temporary support arm is at a withdrawal position.
Figure 9C:
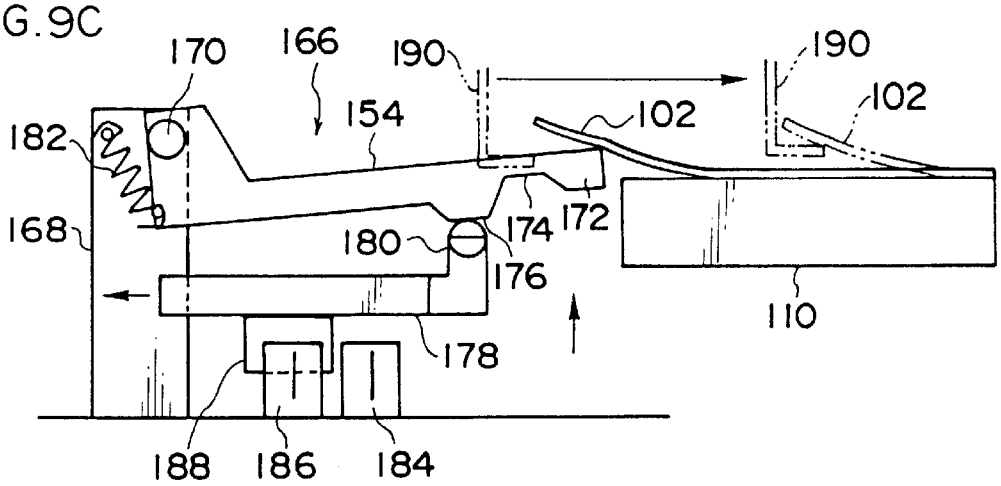
FIG. 9C is a side view of the movement of the eject mechanism section and illustrates a state in which the temporary support arm is at a push-up position.

FIGS. 9A to 9C show a schematic structure of the eject mechanism section 166. At the eject mechanism section 166, the aforementioned pair of the temporary support arms 154 are supported rotarily relative to a stage base 168 through a support shaft 170. The tip end portions of the pair of the temporary support arms 154 are positioned in the vicinity of the surface plate 110. At the lower surface side of each of the temporary support arms 154 are formed a convex portion 172, a concave portion 174, and a convex portion 176 which have different height (depth) dimensions.

A moving stage 178 is provided at the lower portion of the temporary support arm 154. The moving stage 178 can move along the temporary support arm 154. Further, at the tip end of the moving stage 178, rollers 180 are provided so as to abut the bottom surfaces of the temporary support arms 154. Therefore, as the moving stage 178 moves, abutting and supporting positions of the rollers 180 relative to the respective temporary support arms 154 change (to the position of the convex portion 172, the concave portion 174, or the convex portion 176). Accordingly, the height position of the tip end portions of the temporary support arms 154. Further, a spring 182 is connected to the back end portions of the temporary support arms 154 so that the temporary support arms 154 always follow the movement of the moving stage 178.

In the abutting and supporting state of the roller 180 relative to the convex portion 172, as shown in FIG. 9A, each of the temporary support arms 154 is located at a horizontal position whose height is the same as the surface plate 110 top surface. In the abutting and supporting state of the rollers 180 relative to the concave portion 174, as shown in FIG. 9B, the temporary support arm 154 is at a withdrawal position which is lower than the surface plate 110 top surface. In the abutting and supporting state of the rollers 180 relative to the convex portion 176, as shown in FIG. 9C, the temporary support arm 154 is at a push-up position which is higher than the surface plate 110 top surface. Thus, each of the dimensions of the convex portion 172, the concave portion 174, and the convex portion 176 is determined. In this way, since each of the rollers 180 of the moving stage 178 abuts the convex portion 172 of the temporary support arm 154, and the temporary support arm 154 is at a horizontal position which has the same height as the surface plate 110 top surface, hanging of the photopolymer plate 102 on top of the surface plate 110 can be prevented. Further, the rollers 180 of the moving stage 178 abut the convex portion 176 of the temporary support arm 154 so that the temporary support arm 154 is located at the push-up position which is higher than the surface plate 110 top surface, thus lifting up the back end portion of the photopolymer plate 102 on top of the surface plate 110.

A pair of sensors 184 and 186 are disposed at the lower portion of the moving stage 178. These sensors 184 and 186 can detect a position of the moving stage 178, i.e., a position of the temporary support arm 154, by detecting a dog 188. That is, in a state in which only the sensor 184 detects the dog 188, the temporary support arm 154 is located at a horizontal position which has the same height as the surface plate 110 top surface, in a state in which both sensors 184 and 186 detect the dog 188, the temporary support arm 154 is at the withdrawal position which is lower than the surface plate 110 top surface. In a state in which only the sensor 186 detects the dog 188, the temporary support arm 154 is at the push-up position which is higher than the surface plate 110 top surface.

Figure 10:
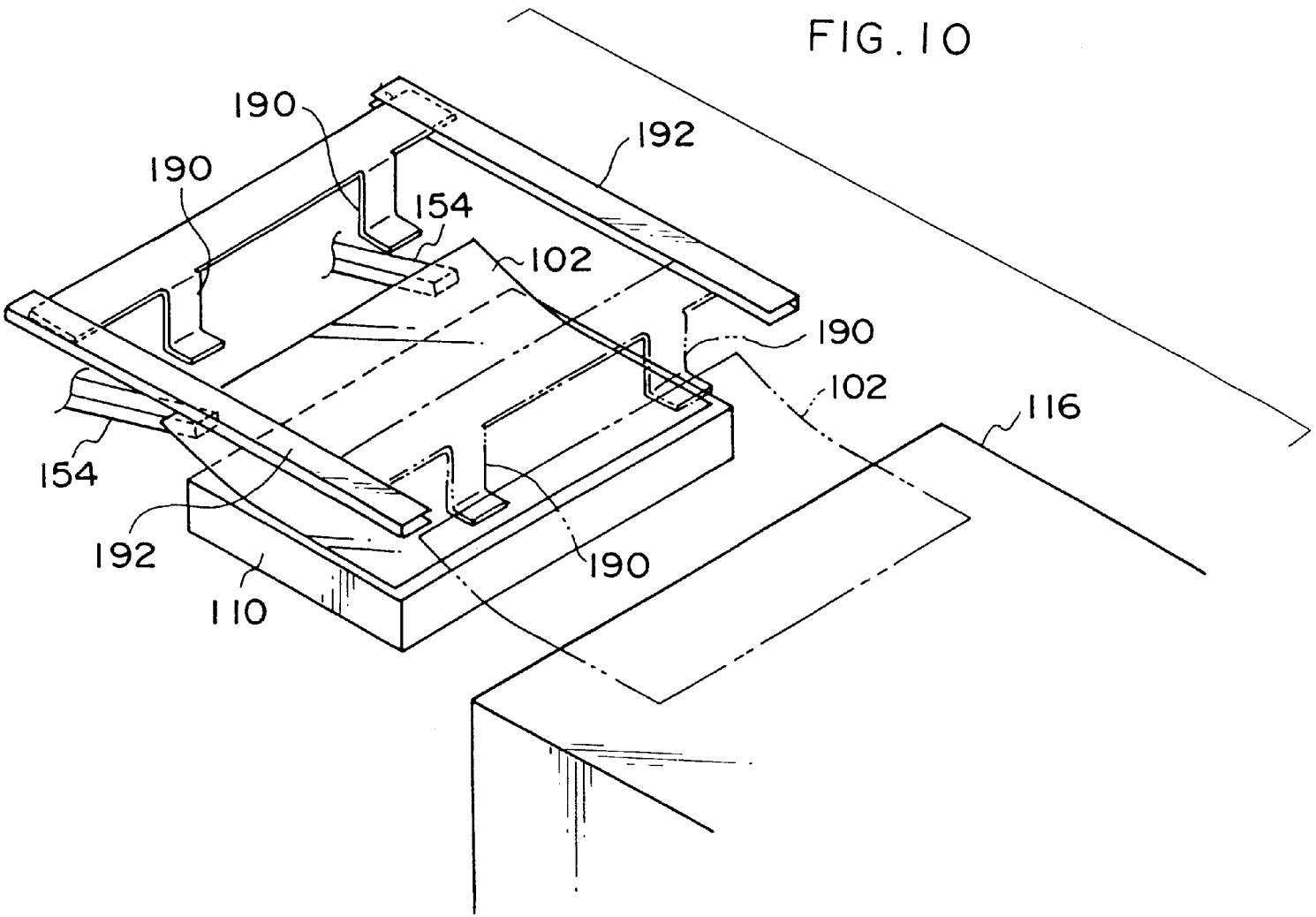
FIG. 10 is a perspective view illustrating plate ejecting pawls of the eject mechanism section.

At the eject mechanism section 166, a pair of plate eject pawls 190 are provided at the upper portion of the temporary support arm 154. As shown in FIG. 10, the pair of these plate eject pawls 190 can move along guide rails 192 which are disposed along the surface plate 110. That is, the plate eject pawls 190 pass over the surface plate 110 and move toward the transport direction front end portion of the photopolymer plate 102.

These plate eject pawls 190 are structured such that, in a state in which the photopolymer plate 102 back end portion that protrudes from the surface plate 110 as described above is lifted up by the temporary support arm 154, the plate eject pawls 190 can engage the photopolymer plate 102 by moving in the photopolymer plate 102 transport direction. Therefore, the photopolymer plate 102 which is engaged by the plate eject pawls 190 is transported to a downstream side of the surface plate 110 in accordance with the movement of the plate eject pawls 190.

At the aforementioned downstream side of the surface plate 110, a buffer section 114 and an automatic development device 116 are provided. The buffer section 114 absorbs a difference between an ejection speed of the eject mechanism section 166 and a transport speed of the automatic development device 116, and delivers the photopolymer plates 102 smoothly.

Figure 11:
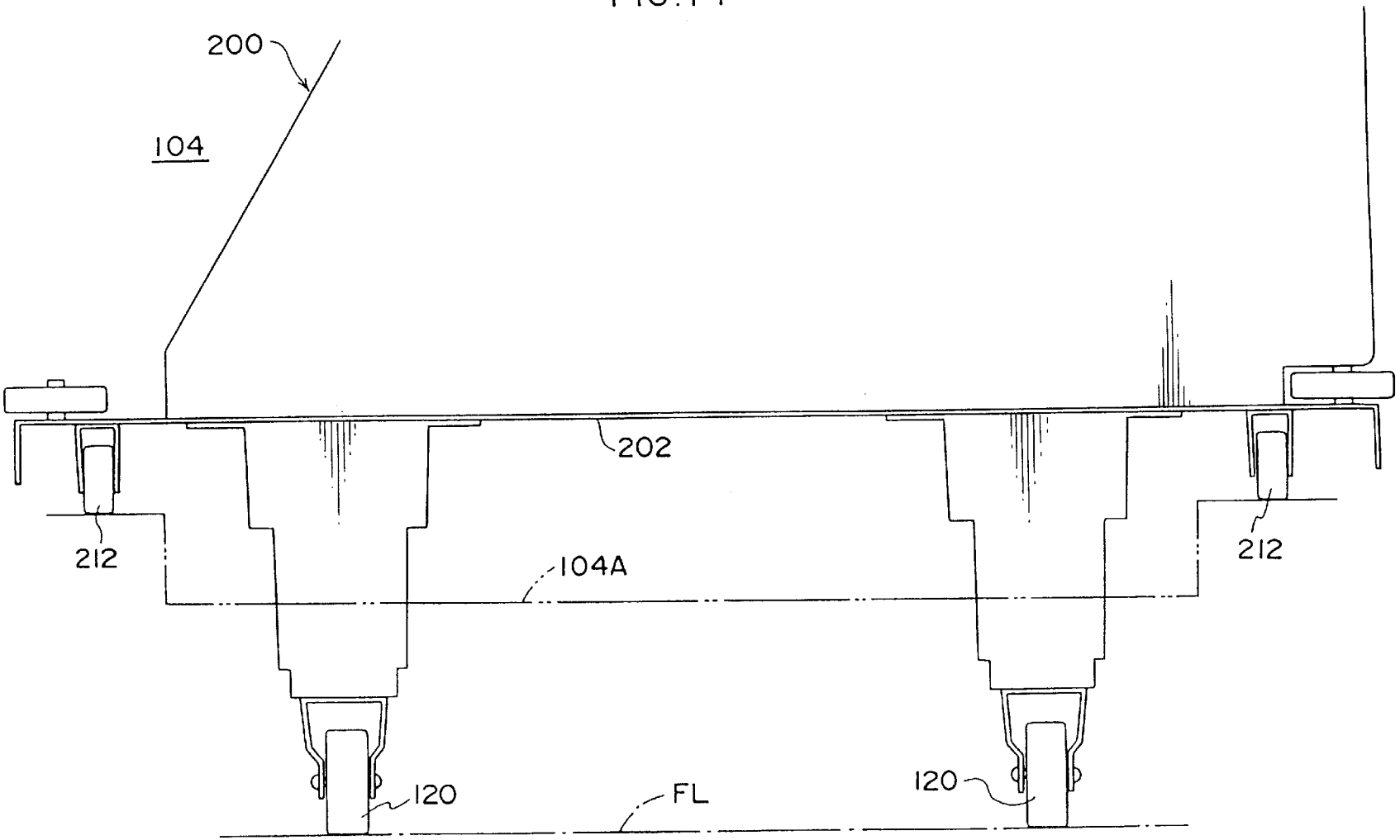
FIG. 11 is an enlarged side view of a lower portion of a trolley.

The trolley 200 is shown in FIGS. 1 and 11. The trolley 200 has a loading platform 202, which is supported at a floor surface FL via the four casters 120 (only two of which are shown in FIG. 11). A handle 204 (see FIG. 1) is attached at the loading platform 202. The handle 204 is substantially curved in a U shape. Both ends of the handle 204 are fixed so as to abut the loading platform 202.

An accumulation section 206, which holds the stacked photopolymer plates 102, is provided at the loading platform 202. Viewed from the side, this accumulation section 206 is substantially in the form of a right-angled triangle. A magazine 208, which accommodates the photopolymer plates 102, is propped up at a slanted face portion of the accumulation section 206.

At the magazine 208, tens of photopolymer plates 102 are stacked in advance (normally 60 plates, but up to 100 plates is possible). Further, a shutter 210 is provided at the magazine 208. Except when in a darkroom, this shutter 210 is left in a closed state to prevent exposure of the photopolymer plates 102.

That is, the trolley 200 can convey the photopolymer plates 102 between the aforementioned accommodating section 104 and a darkroom in which the photopolymer plates 102 are stored, and the shutter 210 can protect the photopolymer plates 102 during conveyance.

The side of the trolley 200 to which the handle 204 is attached faces backward at a time of conveyance. The trolley 200 is accommodated at the plate accommodating section 104.

As shown in FIG. 11, the plate accommodating section 104 is a box-shaped space that has the floor portion 104A which is formed at a position higher than the floor surface FL. The trolley 200 is accommodated at this floor portion 104A by being supported thereat. At this time, the casters 120 of the trolley 200 are folded and supported by a plurality of the auxiliary rollers 212 (six in the present embodiment) which are mounted on the bottom surface of the loading platform 202.

Figure 12:
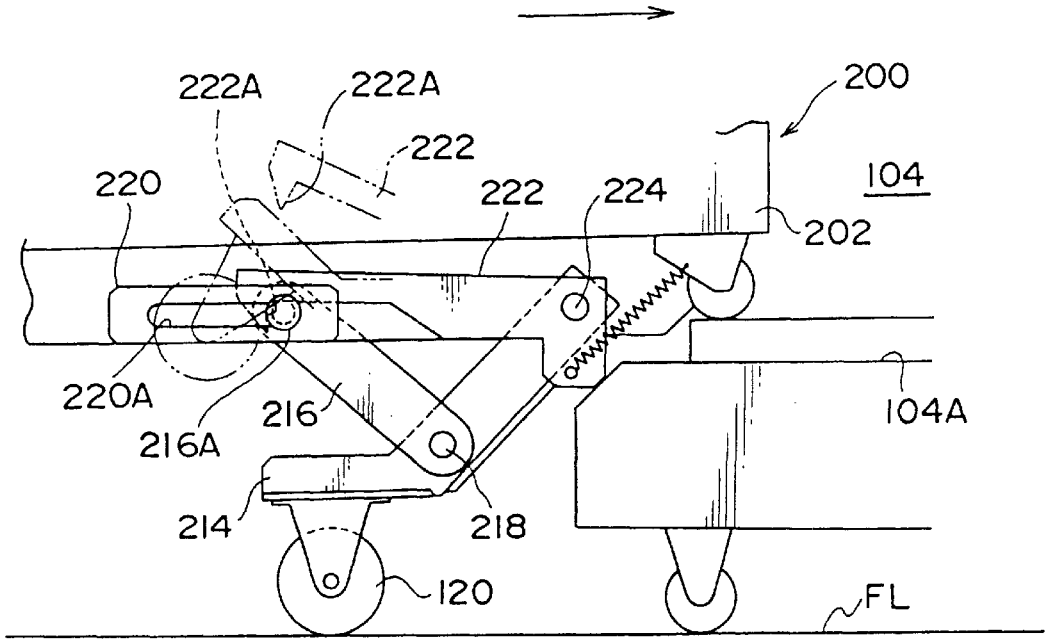
FIG. 12 is a side view illustrating a structure of an accommodating mechanism section of casters.

Folding of the casters 120 is carried out in accordance with the accommodating movement of the trolley 200 at the plate accommodating section 104. As shown in FIG. 12, the casters 120 are mounted to one end of a main arm 214 whose other end is rotarily supported. One end of a supporting arm 216 is rotarily supported at a lengthwise direction interleaf portion of the main arm 214 via a shaft 218. To the other end of the supporting arm 216 is mounted a slide pin 216A. The slide pin 216A is accommodated in an elongated hole 220A of the fixed rail arm 220.

In an ordinary state (a fixed state of the casters 120), the slide pin 216A is engaged by a hook portion 222A which is formed at one end portion of an L-shaped arm 222, and is held in the vicinity of one end portion of the elongated hole 220A.

The curved portion of the L-shaped arm 222 is supported via a rotating shaft 224 of the main arm 214. The other end portion of the L-shape arm 222 is disposed at a position that abuts the end surface of the floor portion 104A of the plate accommodating section 104.

When the other end portion of the L-shaped arm 222 in a state that abuts the end surface of the floor portion 104A is further pushed, the L-shaped arm 222 rotates around the rotating shaft 224 as a center so that the hook portion 222A is disengaged from the slide pin 216A.

Due to this disengagement from the slide pin 216A, the supporting arm 216 to which the slide pin 216A is attached is moved to the other end portion of the elongated hole 220A by an urging force of an urging means. Therefore, in accordance with the movement of the elongated hole 220A, the main arm 214 is lifted up, and the casters 200 separate from the floor surface. Further, the trolley 200 at this time is supported relative to the floor portion 104A via the above-described auxiliary rollers 212.

An operation of the present embodiment will be described below.

In a case in which the photopolymer plates 102 are accommodated at the plate accommodating section 104 of the automatic exposure device 100, the photopolymer plates 102 together with the trolley 200 are accommodated at the plate accommodating section 104 so that the photopolymer plates 102 can be positioned at a predetermined position.

Because the photopolymer plates 102 are stored in a darkroom apart from the automatic exposure device 100, an operator pushes the trolley 200 to the darkroom where the photopolymer plates 102 are mounted in a unit of the magazine 208 at a predetermined position (of the accumulating section 206) of the trolley 200. At this time, the shutter of the magazine 208 is left closed.

The operator finishes mounting of the magazine 208, then again conveys the trolley 200 to the automatic exposure device 100, opens an open-close cover (which is equipped at the trolley 200 side in FIG. 3), and accommodates the trolley 200 at the plate accommodating section 104.

The floor portion 104A of the plate accommodating section 104 is formed at a higher position than the floor surface FL. However, in the present embodiment, a structure of folding the casters 120 is applied such that the trolley 20 can be accommodated at the floor portion 104A of the plate accommodating section 104 without changing the height position of the trolley 200. That is, the support of the trolley 200 is handed over from the casters 120 to the auxiliary rollers 212 so that the trolley 200 is handed over smoothly from the floor surface FL having a difference in level to the floor portion 104A. As a result, the plate accommodating section 104 may have a structure with high rigidity by enclosing the periphery thereof with a frame body (a so-called closed cross-sectional structure), thus allowing the plate accommodating section 104 to use a cover body which has excellent shielding performance.

After the trolley 200 has been accommodated at the plate accommodating section 104, the sheet delivery section 106 alternately takes the photopolymer plates 102 and the interleaf sheets 118 from the stacked state thereof and passes them onto the plate feed section 108. The photopolymer plates 102 which have been passed onto the plate feed section 108 are transported by the common transport section 128 and the photopolymer plate transport section 130, then fed to the surface plate 110, and ejected after a predetermined image has been exposed.

On the other hand, the interleaf sheets 118 are transported by the common transport section 128 and the interleaf transport section 134, and then stacked at the interleaf accommodating section 132 by the sheet material stacking device 141 which is provided at the trolley 200.

One of the interleaf sheets 118 which are transported from the interleaf sheet transfer section 134 is fed into a gap between the rollers 144 which face each other while being guided by the guide plates 146. Further, the interleaf sheet 118, which has been fed into the rollers 144, is forcibly fed to the interleaf sheet accommodating section 132, while being nipped by the rollers 144, and stacked.

Therefore, even when the interleaf sheets 118 are extremely thin, as compared to a case in which the interleaf sheets 118 are dropped and stacked at random, the interleaf sheets 118 can behave stably, and can be stacked regularly. For this reason, a number of the interleaf sheets 118 can effectively be stacked at the interleaf sheet accommodating section 132 whose space is limited.

The rollers 144 nip and transport the interleaf sheets 118 at a speed which is faster than the speed of the interleaf sheet transport section 134. Thus, when one of the interleaf sheets 118 passes down between the rollers 144, the interleaf sheet 118 maintains a so-called stronger pulling tension and does not slacken as it is being nipped by the rollers 144. Therefore, jamming of the interleaf sheet 118 due to slackness or the like can be prevented so that the interleaf sheets 118 can be stacked stably.

As described above, at the interleaf sheet transport section 134, since a difference is made between the nipping forces of the narrow belts 140 and the rollers 144 with respect to the interleaf sheet 118, and the nipping force of the narrow belts 140 is set to be weaker than that of the rollers 144, a transport speed difference between the narrow belts 140 and the rollers 144 can be absorbed effectively. Accordingly, the interleaf sheets 118 can be prevented from being damaged due to slipping.

Wrap-around prevention boards 150 are provided in the vicinity of the lower portions of the rollers 144 such that edges of the wraparound prevention boards 150 follow along projections and indentations of each of these skewered shapes of the rollers 144. Hence, even if portions of the interleaf sheets 118 which have passed through the rollers 144 and been stacked in the interleaf sheet accommodating section 132 come into contact with the rollers 144, wrap-around can be prevented by the wrap-around prevention board 150.

A width of the outlet portion between the guide plates 146 which face each other is smaller than a width of the inlet portion between the wrap-around prevention boards 150 which face each other. Portions of the guide plates 146 fit into the wrap-around prevention boards 150. Due to this guiding structure of the guiding plates 146, the interleaf sheet 118 can be reliably discharged to the interleaf sheet accommodation section 132 provided at the downstream side. Such a structure as described above is particularly effective when it is used for an extremely thin and so-called nerveless sheet material such as the interleaf sheet 118.

At the guide plates 146 which guide the interleaf sheets 118 to the rollers 144, anti-static brushes 148 are respectively attached, which anti-static brushes 148 engage the interleaf sheets 118 which are guided into the gap between the facing rollers 144 and remove static electricity (electric charge) from the interleaf sheets 118. Accordingly, the interleaf sheets 118, each of which passes through between the rollers 144 and which are fed to the interleaf sheet accommodating section 132, do not unnecessarily adhere to the internal walls of the interleaf accommodating section 132. As a result, stacking efficiency of the interleaf sheets 118 does not deteriorate.

In this way, in the sheet material stacking device 141 and the automatic exposure device 100 to which this sheet material stacking device 141 has been applied of the present embodiment, the interleaf sheets 118 as sheet materials are forcibly fed by the rollers 144 to the interleaf sheet accommodating section 132 as an accommodating section. Thus, even extremely thin interleaf sheets 118 can behave stably, and can be stacked regularly at the interleaf sheet accommodating section 132. As a result, a number of the interleaf sheets 118 can effectively be stacked at the interleaf sheet accommodating section 132 having a limited space.

What is claimed is:

1. A sheet material stacking device for stacking, at a stacking section which is provided at a downstream side, sheet materials which are transported from an upstream side, comprising:

a pair of nipping and feeding members which are disposed at a sheet material transport direction upstream side of the stacking section, which receive the sheet materials which are transported from the upstream side, and which forcibly feed the sheet material to said stacking section;

a guiding device which is disposed at the sheet material transport direction upstream side of said nipping and feeding members, and which guides said sheet materials which are transported from the upstream side into a gap between said nipping and feeding members which face each other, wherein said guiding device has a pair of guide plates disposed so as to form a tapered shape having a width which gradually reduces toward said gap;

a sheet material transport section which is disposed at said sheet material transport direction upstream side of said guiding device, wherein said sheet material transport section has a transport mechanism which is formed by a plurality of narrow belts only, and transports said sheet materials by a weak nipping force; and wrap-around prevention boards corresponding to each of the pair of nipping and feeding members which prevent the sheet material which has passed through the nipping and feeding members from engaging again with said nipping and feeding members.

2. The sheet material stacking device of claim 1, wherein said nipping and feeding members nip and transport said sheet materials at a speed faster than the speed of said sheet materials which are transported from the upstream side.

3. The sheet material stacking device of claim 1, wherein while one of said sheet materials is transported by said sheet material transport section and said nipping and feeding members at the same time, the sheet material maintains a state of predetermined tension.

4. The sheet material stacking device of claim 1, wherein said sheet material transport direction is a vertical direction.

5. The sheet material stacking device of claim 1, further comprising anti-static brushes which engage with the sheet material which is guided into said gap and which remove static electricity from said sheet material.

6. The sheet material stacking device of claim 1, wherein said nipping and feeding members are nipping and feeding rollers.

7. The sheet material stacking device of claim 6, wherein said nipping and feeding rollers are a plurality of skewered rollers which are provided at a rotational shaft.

8. The sheet material stacking device of claim 1, wherein said guiding device has anti-static brushes which engage with the sheet material which is guided into said gap and which remove static electricity from said sheet material.

9. A sheet material stacking device for stacking, at a stacking section which is provided at a downstream side, sheet materials which are transported from an upstream side, comprising:

a pair of nipping and feeding members which are disposed at a sheet material transport direction upstream side of the stacking section, which receive the sheet materials which are transported from the upstream side, and which forcibly feed the sheet material to said stacking section;

a guiding device which is disposed at the sheet material transport direction upstream side of said nipping and feeding members, and which guides said sheet materials which are transported from the upstream side into a gap between said nipping and feeding members which face each other, wherein said guiding device has a pair of guide plates disposed so as to form a tapered shape having a width which gradually reduces toward said gap;

wherein said nipping and feeding members are nipping and feeding rollers; and wherein said nipping and feeding rollers are a plurality of skewered rollers which are provided at a rotational shaft; and wrap-around prevention boards which are provided such that they follow along projections and indentations formed by each of the plurality of said skewered rollers which are provided at said rotational shaft and which prevent the sheet material which has passed through between said skewered rollers from engaging again with said skewered rollers.

10. An automatic exposure device for a printing plate which comprises: a conveying device which is able to mount and convey a magazine in which a plurality of printing plates, each of which has a photosensitive layer on top of a support, and a plurality of interleaf sheets for protecting plate surfaces of the printing plates are in a state of being stacked alternately in a sequential order; and an accommodating device which is able to accommodate said conveying device of said printing plates, and which ejects said printing plates after an image has been exposed;

a take-out device which alternately takes said printing plates and said Interleaf sheets from the stacked state thereof one at a time from said magazine; and an interleaf sheet stacking device which stacks said interleaf sheets which are transported from said take-out device at an upstream side, at the interleaf sheet accommodating section which is provided at a downstream side, wherein said interleaf stacking device comprises:

a pair of nipping and feeding members which are disposed at the interleaf sheet transport direction upstream side of said interleaf sheet accommodating section, which receive said interleaf sheets which are transported from said take-out device, and which forcibly feed said interleaf sheets to said interleaf sheet accommodating section; and a guiding device which is disposed at said interleaf sheet transport direction upstream side of said interleaf sheet accommodating section, and which guides said interleaf sheets which are transported from said take-out device into a gap between said nipping and feeding members, wherein said guiding device has a pair of guide plates disposed so as to form a tapered shape having a width which gradually reduces toward said gap; and wrap-around prevention boards which correspond to each of the pair of nipping and feeding members and prevent the interleaf sheets which have passed through the nipping and feeding members from engaging again with said nipping and feeding members.

11. The automatic exposure device for a printing plate of claim 10, wherein said conveying device is a trolley which conveys printing plates and which is supported by a plurality of casters.

12. The automatic exposure device for a printing plate of claim 10, wherein said conveying device includes said interleaf sheet stacking device.

13. The automatic exposure device for a printing plate of claim 10, wherein an interleaf sheet transport section is provided at said interleaf sheet transport direction upstream side of said guiding device, and said interleaf sheets are nipped and transported by said nipping and feeding members at a speed faster than the speed of said interleaf sheet transport section.

14. The automatic exposure device for a printing plate of claim 10, wherein while said interleaf sheets are being transported by said interleaf sheet transport section and said nipping and feeding members at the same time, the interleaf sheet maintains a state of predetermined tension.

15. The automatic exposure device for a printing plate of claim 10, wherein said nipping and feeding members are a plurality of skewered rollers provided at a rotational shaft.

* * * * *